US007866417B2

(12) United States Patent
Buske et al.

(10) Patent No.: US 7,866,417 B2
(45) Date of Patent: Jan. 11, 2011

(54) SELF SHARPENING STEEL TOOTH CUTTING STRUCTURE

(75) Inventors: Robert J. Buske, The Woodlands, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 12/255,479

(22) Filed: Oct. 21, 2008

(65) Prior Publication Data

US 2010/0078226 A1 Apr. 1, 2010

Related U.S. Application Data

(63) Continuation-in-part of application No. 12/239,025, filed on Sep. 26, 2008.

(51) Int. Cl.
*E21B 10/16* (2006.01)
*E21B 10/50* (2006.01)

(52) U.S. Cl. ..... 175/374; 175/375; 175/376; 175/425

(58) Field of Classification Search ..... 175/374, 175/375, 378, 425, 379
See application file for complete search history.

(56) References Cited

U.S. PATENT DOCUMENTS 2,527,838 A * 10/1950 Morlan et al. ..... 175/376
2,939,684 A * 6/1960 Payne ..... 175/375
4,752,916 A 6/1988 Loewenthal
5,351,769 A 10/1994 Scott
5,445,231 A 8/1995 Scott et al.
5,586,082 A 12/1996 Anderson et al.
5,831,934 A 11/1998 Gill et al.
5,899,958 A 5/1999 Dowell et al.
5,995,447 A 11/1999 Mandal et al.
6,138,779 A 10/2000 Boyce
6,206,115 B1 3/2001 Overstreet
6,374,704 B1 4/2002 Scott et al.
6,564,884 B2 5/2003 Bird
6,766,870 B2 7/2004 Overstreet
6,782,958 B2 8/2004 Liang
7,035,165 B2 4/2006 Tang
7,240,746 B2 7/2007 Overstreet et al.
7,343,990 B2 3/2008 Pessier
7,346,454 B2 3/2008 Mathieu et al.
7,492,664 B2 2/2009 Tang et al.
2004/0158997 A1 8/2004 Tang (Continued)

FOREIGN PATENT DOCUMENTS

WO 9859264 12/1998

OTHER PUBLICATIONS

Ilya Tsvankin, Normal Moveout From Dipping Reflectors in Anisotropic Media, Geophysics, vol. 60, No. 1, Jan.-Feb. 1995, p. 268-284.

(Continued)

*Primary Examiner*—Giovanna C Wright
(74) *Attorney, Agent, or Firm*—Bracewell & Giuliani LLP

(57) ABSTRACT

An earth boring drill bit comprising a milled cutter having rows of teeth hardfacing guides on the cutter. Hardfacing is applied between adjacent teeth hardfacing guides to form a cutting element. The hardfacing may include an annular body with ridges that outwardly project from the body.

14 Claims, 6 Drawing Sheets

U.S. PATENT DOCUMENTS

| | | | |
|---|---|---|---|
| 2006/0031017 | A1 | 2/2006 | Mathieu et al. |
| 2007/0097788 | A1 | 5/2007 | Tang et al. |

OTHER PUBLICATIONS

Yibing Zheng, et al., Imaging Near-Borehole Structure Using Acoustic Logging Data With Pre-Stack F-K Migration, 4 pages.
http://segdl.aip.org/vsearch/servlet/VerityServlet?pgID=abs_wrap &prog=searchid=GPY, Synthetic Full-Waveform Acoustic Logs In Cased Boreholes, II-Poorly Bonded Casing, Kenneth M. Tubman et al., Jun. 14, 2006, 2 pages.
Chung Chang, et al., Localized Maps of the Subsurface, Oilfield Review, p. 56-66.
http://www.elsevier.com/wps/find/bookdescription.print/699894/ description, Quantitative Borehole Acoustic Methods, 24, X.M. Tang et al. Jun. 14, 2006, 2 pages.
Brian E. Hornby, Imaging of Near-Borehole Structure Using Full-Waveform Sonic Data, Geophysics vol. 54, No. 6, Jun. 1989, 13 pages.
B. Joyce et al, Introduction of a New Omni-Directional Acoustic System For Improved Real-Time LWD Sonic Logging-Tool Design and Field Test Results, 14 pages.
Cengiz Esmersoy, et al. Acoustc Imagng of Reservoir Stucure From A Horizontal Well, The Leading Edge, vol. 17, Issue 7, Jul. 1998, p. 940-946.
Y. Li et al., Single-Well Imaging With Acoustic Reflection Survey at Mounds, Oklahoma, USA, EAGE 64th Conference & Exhibition—Florence, Italy May 27-30, 2002, 4 pages.
4.2.3.1 Wave Separation, Chapter 4—Permeability Estimation, 2 pages.
Xiaoming Tang, Imaging Near-Borehole Structure Using Directional Acoustic-Wave Measurement, Geophysics, vol. 69, No. 6, Nov.-Dec. 2004, p. 1378-1386.
Xiao Tang, Predictive Processing of Array Acoustic Waveform Data, Geophysics, vol. 62, No. 6, Nov.-Dec. 1997, p. 1710-1714.

* cited by examiner

Fig. 6
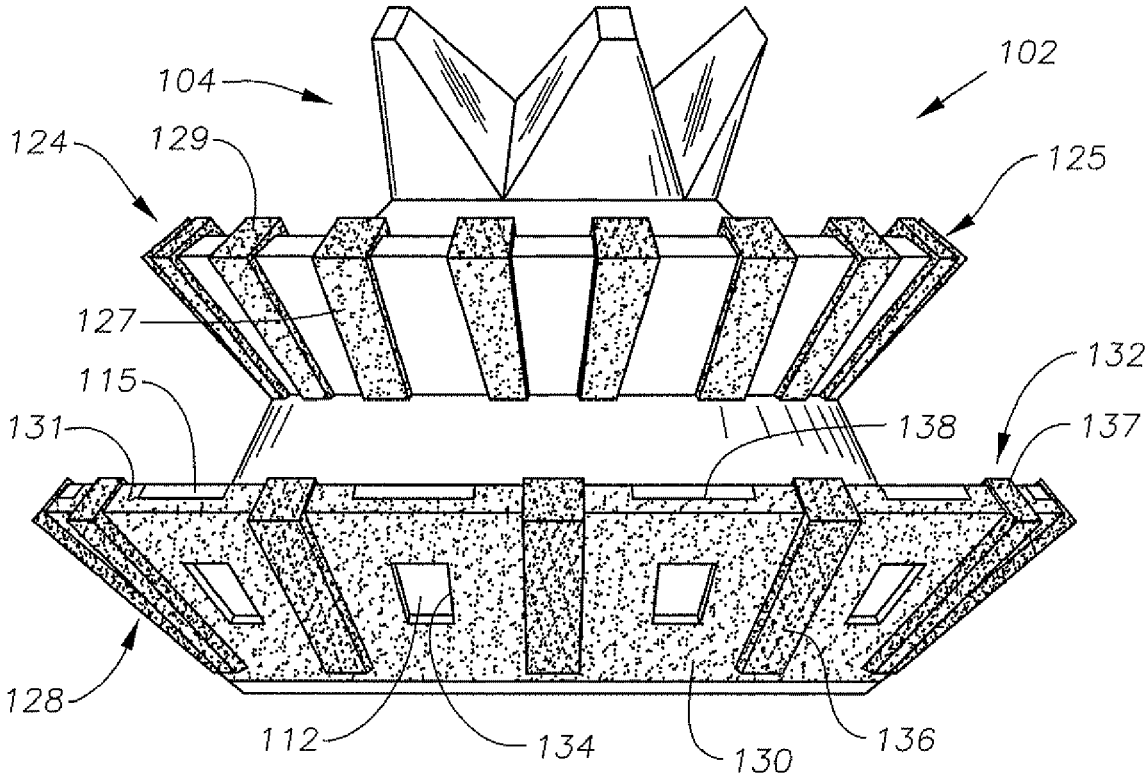
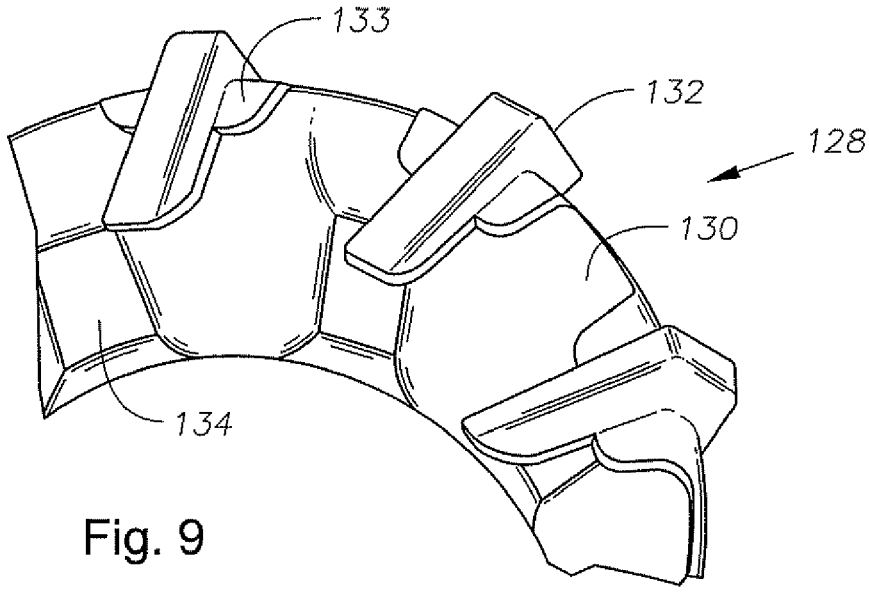
Fig. 9

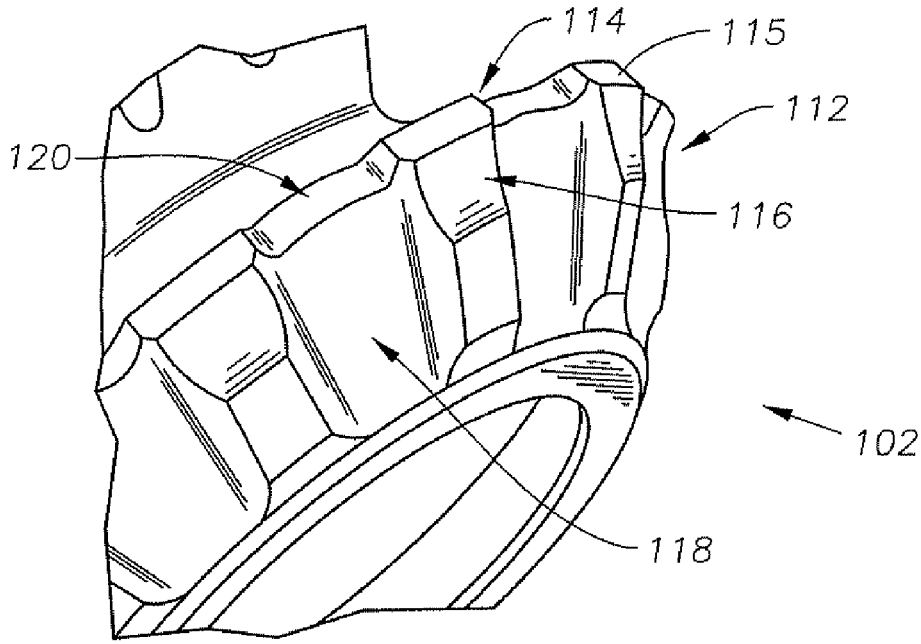
Fig. 7
Fig. 8
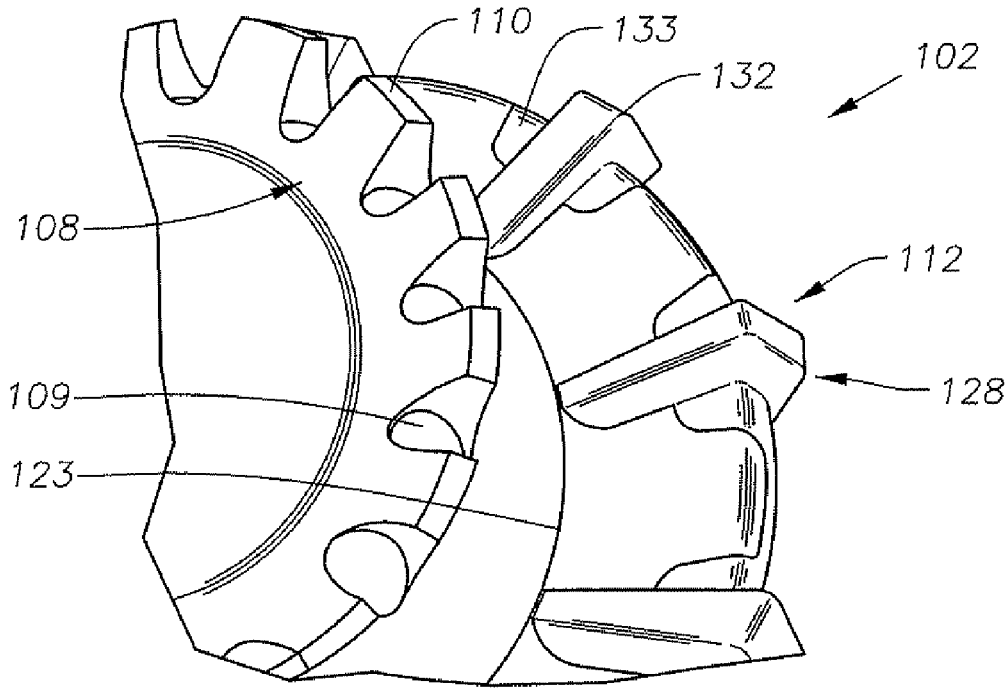

SELF SHARPENING STEEL TOOTH CUTTING STRUCTURE

CROSS REFERENCE TO RELATED APPLICATIONS

This application is a continuation in part of U.S. utility patent application Ser. No. 12/239,025, filed on Sep. 26, 2008, the disclosure of which is incorporated herein by reference in its entirety.

BACKGROUND

1. Field of Invention

The disclosure herein relates in general to rolling cone earth boring bits, and in particular to improving the performance of a steel tooth bit.

2. Description of Prior Art

Drilling systems having earth boring drill bits are used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation.

Drill bits typically are chosen from one of two types, either drag bits or roller cone bits. Rotating the bit body with the cutting elements on the outer surface of the roller cone body crushes the rock and the cuttings may be washed away with drilling fluid. One example of a roller cone bit 11 is provided in a side partial perspective view in FIG. 1, the bit 11 having a body 13 with a threaded attachment 15 on the bit 11 upper end for connection to a drill string (not shown). The bit 11 further includes legs 18 extending downward from the bit body 13. Each bit leg 18 is shown having a lubricant compensator 17.

The bit body 13 is further illustrating having a nozzle 19 for directing pressurized drilling fluid from within the drill string to cool and lubricate bit 11 during drilling operation. A plurality of cutters 21 are rotatably secured to respective bit legs 18. Typically, each bit 11 has three cutters 21, and one of the three cutters is obscured from view in FIG. 1.

Each cutter 21 has a shell surface including a gauge surface 25 and a heel region indicated generally at 27. Teeth 29 are formed in heel region 27 and form a heel row 28 of teeth. The heel teeth 29 depicted are of generally conventional design, each having leading and trailing flanks 31 which converge to a crest 33. Each tooth 29 has an inner end (not shown) and an outer end 35 that join to crest 33.

Typically steel tooth bits are for penetration into relatively soft geological formations of the earth. The strength and fracture toughness of the steel teeth permits the use of relatively long teeth, which enables the aggressive gouging and scraping actions that are advantageous for rapid penetration of soft formations with low compressive strengths. However, geological formations often comprise streaks of hard, abrasive materials that a steel-tooth bit should penetrate economically without damage to the bit. Although steel teeth possess good strength, abrasion resistance is inadequate to permit continued rapid penetration of hard or abrasive streaks. Consequently, it has been common in the arts since at least the 1930s to provide a layer of wear-resistant material called "hardfacing" over those portions of the teeth exposed to the severest wear. The hardfacing typically consists of extremely hard particles, such as sintered, cast, or macrocrystalline tungsten carbide, dispersed in a steel matrix.

Typical hardfacing deposits are welded over a steel tooth that has been machined similar to the desired final shape. Generally, the hardfacing materials do not have a tendency to heat crack during service which helps counteract the occurrence of frictional heat cracks associated with carbide inserts. The hardfacing is more wear-resistant than the steel tooth material, therefore the hardfacing on the surface of steel teeth makes the teeth more resistant to wear.

A front view of a cutter 21 is illustrated in FIG. 2. Shown formed on the cutter 21 is an inner row 36 having inner row teeth 37 extending radially inward from the heel 27. The inner row teeth 37 have flanks 31 and crests 33 similar to those of the heel teeth 29. An apex 38 is shown proximate to the cutter 21 center, the apex 38 having grooves 39 radially extending from the apex 38 midpoint to its outer periphery. A layer of hardfacing 35 is shown having been applied to surfaces of the heel teeth 29 and the inner row teeth 37.

SUMMARY OF INVENTION

Disclosed herein is an earth boring drill bit comprising, a milled cutter having rows of teeth hardfacing guides on the cutter. The hardfacing may extend past the crest of the teeth hardfacing guides or end along the teeth hardfacing guides flanks. In one embodiment, an earth boring bit includes a body, a leg depending from the body, a bearing shaft extending radially inward from the leg, a cutter mounted on the bearing shaft, the cutter having a row of cutting teeth hardfacing guides, the teeth hardfacing guides having a base and flanks extending from the base and joining to form a crest, and hardfacing extending from a first flank onto an oppositely facing second flank, wherein the first flank and second flank are disposed on adjacently disposed teeth hardfacing guides. The web includes ridges projecting laterally upward from the web and extending along the web inner and outer surfaces, the ridges formed to be the primary cutting elements

BRIEF DESCRIPTION OF DRAWINGS

Some of the features and benefits of the present invention having been stated, others will become apparent as the description proceeds when taken in conjunction with the accompanying drawings, in which:

FIG. 6 is a side view of the cutter of FIG. 5.

FIG. 7 depicts, in perspective view, an example of a cutter profiled for having hardfacing applied thereon.

FIG. 8 is a perspective view of the cutter of FIG. 7 having hardfacing on a heel row.

FIG. 9 illustrates hardfacing for use on a cutter.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
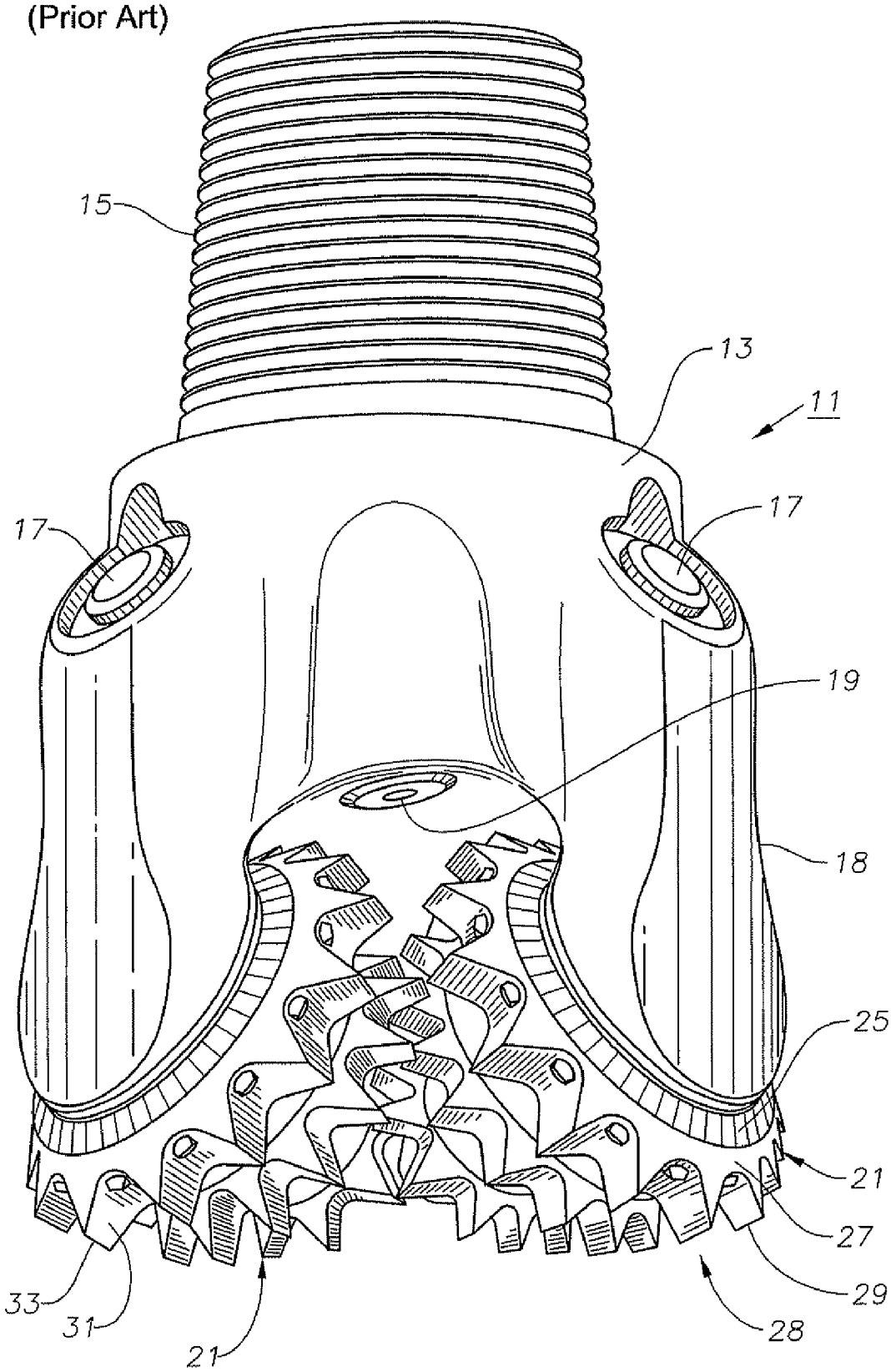
Fig. 1 (Prior Art)
FIG. 1 is a side perspective view of a prior art roller cone bit.
Figure 2:
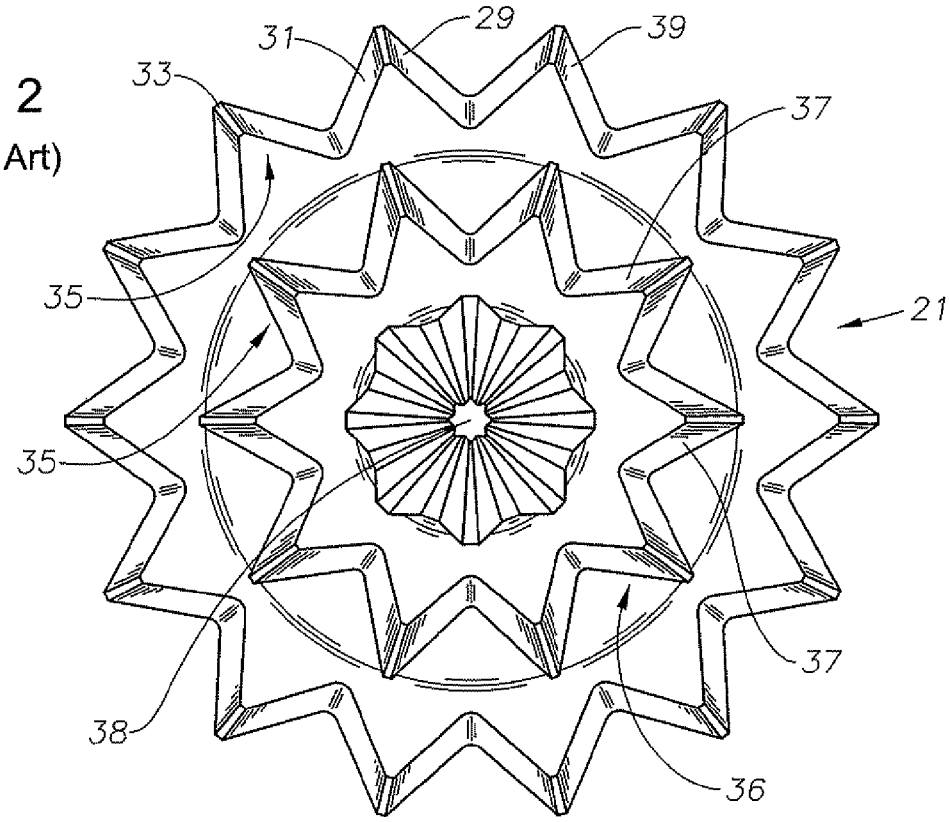
Fig. 2 (Prior Art)
FIG. 2 depicts a front view of a prior art milled steel tooth cutter.
Figure 3A:
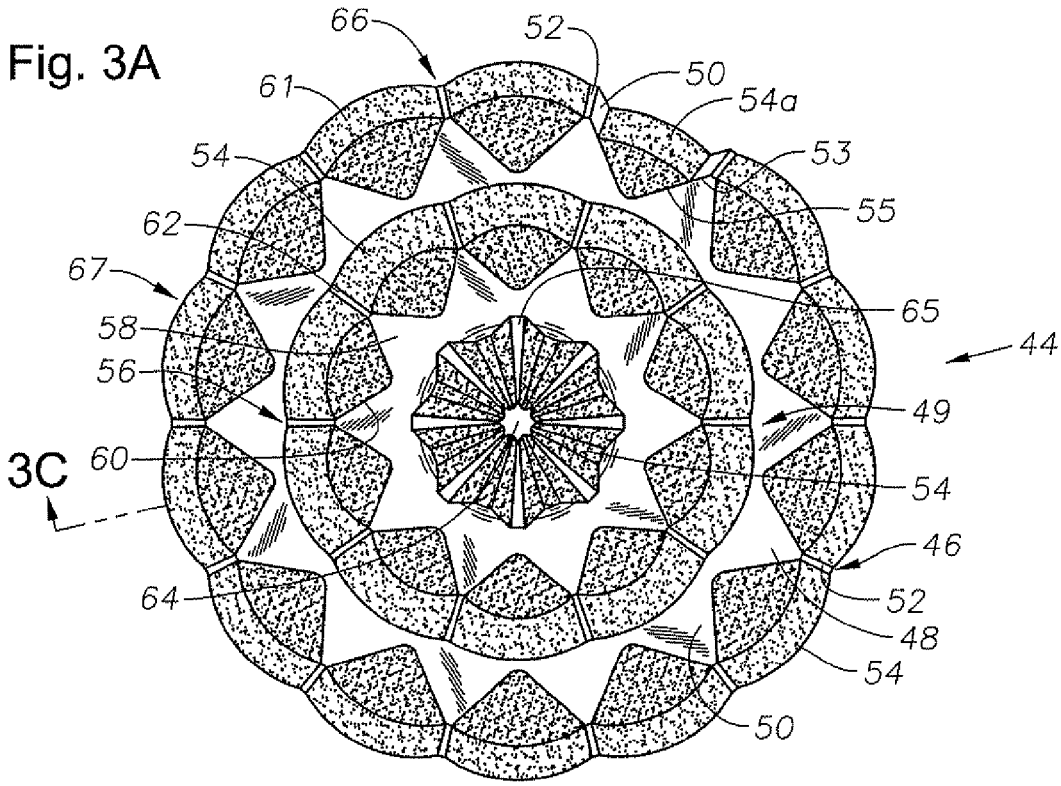
FIGS. 3*a* and 3*b* illustrate a front view of a cutter in accordance with the present disclosure.
Figure 3B:
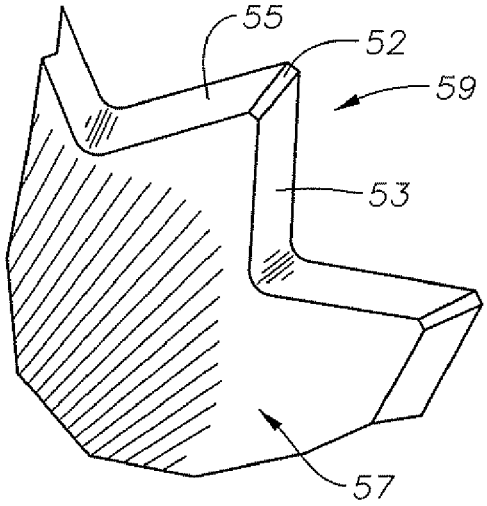

With reference now to FIG. 3*a* an example of a roller cone with cutter 44 in accordance with the present disclosure is illustrated in a front view. The cutter 44 comprises heel teeth hardfacing guides 48 arranged on its outer periphery forming a heel row 46. The heel teeth hardfacing guides 48 are defined by flanks 50 on opposing sides of the teeth hardfacing guides 48. The flanks 50, which comprise leading 53 and trailing 55 flanks, are inwardly angled upward from a base 49 and join to form a crest 52. In FIG. 3*b*, an example of a portion of the heel row, 46 is depicted in perspective view illustrating an inner side 57 and an outer side 59.

Hardfacing 54 has been added to the gap between oppositely facing flanks 50 of adjacently disposed teeth hardfacing guides 48. The hardfacing 54 is affixed to the flanks 50 and comprises a cutting structure for use in earth boring operations when implementing the cutter 44 with an earth boring bit. In one example of use, the teeth hardfacing guides 48 comprise steel, which is softer than hardfacing, thus wearing quicker during boring operations. As the steel teeth hardfacing guides 48 wear down, the hardfacing 54 remains affixed between adjacently disposed teeth hardfacing guides 48 to continue providing a cutting surface. As the hardfacing 54 wears, the circumferential cutting contact length decreases to improve drilling. The upper surface 61 of the hardfacing 54 can optionally form a generally sharp crest 67 which can have roughly the same thickness as crests 52 of the teeth hardfacing guides 48. Also, the hardfacing crest 67 has a generally curved contour from tooth hardfacing guides to tooth hardfacing guides. The curved contour preferably bulges out leaving a valley 66 between the crests. The hardfacing 54 can be flush with one or both of the inner side 57 or outer side 59. Similarly, hardfacing 54 can be flush or bulge outward on the inner row 56 sides.

The cutter 44 of FIG. 3*a* also includes an inner row of teeth hardfacing guides 58 forming an inner row 56 concentric within the heel row 46. The inner row of teeth hardfacing guides 58 also include flanks 60 angled inward to form a crest 62 at the outward end of the teeth hardfacing guides 58. Hardfacing 54 may optionally be included within the gaps existing between the oppositely facing flanks 60 on adjacently disposed teeth hardfacing guides 58. The cutter 44 also optionally includes an apex 64 provided on its upper surface, the apex 64 can have teeth hardfacing guides 65 thereon forming a grooved or profiled upper surface and include hardfacing 54 thereon.

Embodiments exist where hardfacing 54 is applied only between teeth hardfacing guides 48 of the heel row 46 or optionally only between teeth hardfacing guides 58 of the inner row 56 or rows not shown. The amount of hardfacing 54 can also vary. The hardfacing 54 can extend outward from the gap past the crests 52 of adjacently disposed teeth hardfacing guides 48, 58. Optionally, hardfacing 54a can be added having a terminal upper surface remaining within the gap.

Figure 3C:
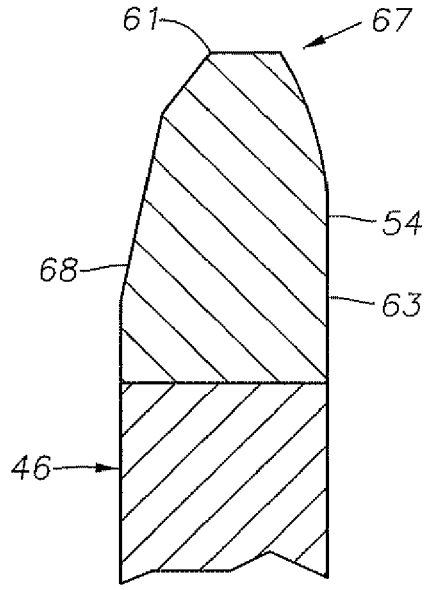
FIG. 3*c* is a cross sectional view of a portion of the cutter of FIG. 3*a*.

FIG. 3*c* is a cross sectional view of a portion of an embodiment of the cutter 44 of FIG. 3*a*. Hardfacing 54 is shown extending away from the trough of a heel row 46 with a generally planar front surface 63 and a rear surface 68 contoured toward the front surface 63 so at the hardfacing upper edge 61 the crest 67 width is smaller than the heel row 46 width.

Figure 4:
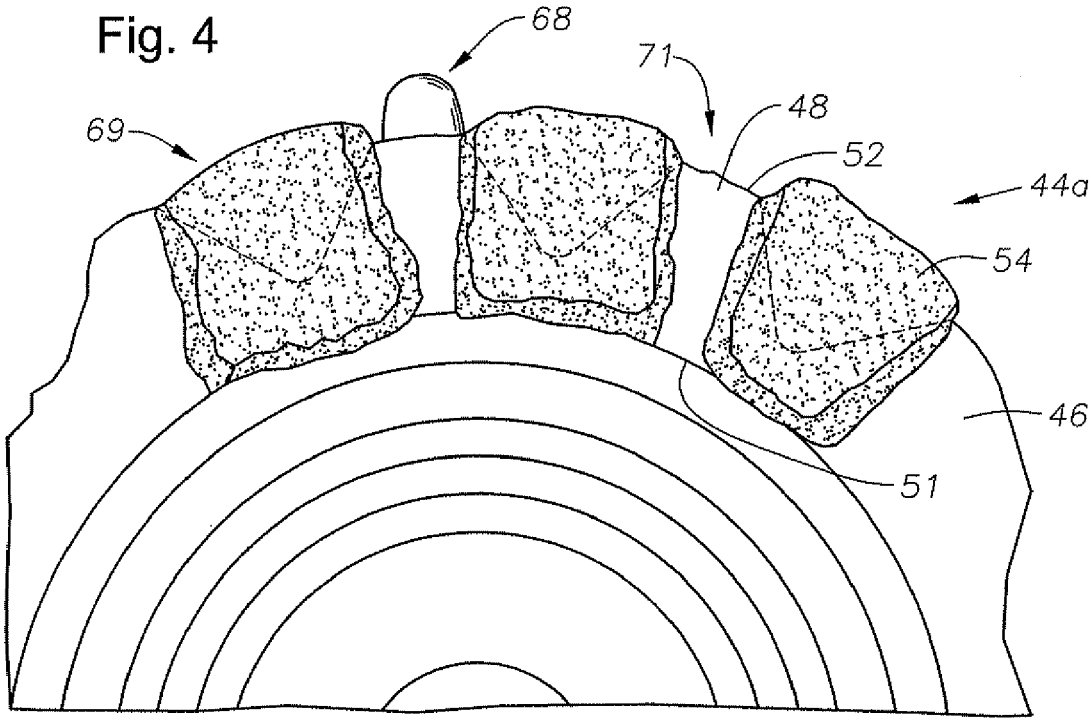
FIG. 4 illustrates a rear view of a cutter in accordance with the present disclosure.

FIG. 4 depicts a rearward view of an embodiment of a cutter 44*a* having webs 69 of hardfacing 54 spanning between adjacent heel teeth hardfacing guides 48 formed on the roller cone with cutter 44*a*. In this view the hardfacing 54 extends downward below the crest 52 of the heel teeth hardfacing guides 48 and terminating at a cutter hub 51. Spaces 71 are shown between adjacent webs 69, however the hardfacing 54 can comprise a single member over the teeth hardfacing guides. Although hardfacing 54 is not shown on the gauge surface in this embodiment, hardfacing 54 can be applied to the gauge surface.

Figure 5:
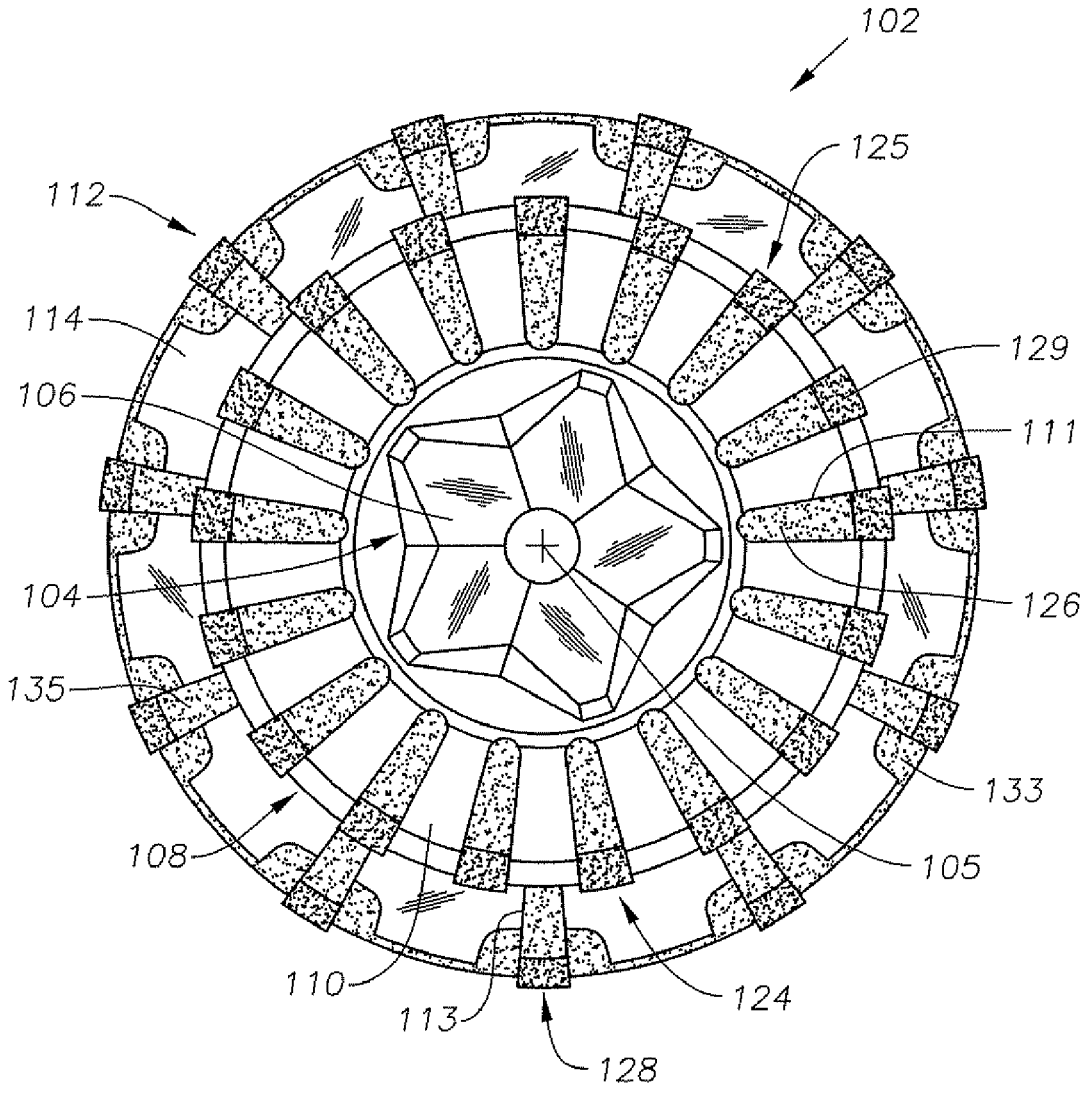
FIG. 5 is a frontal view of an alternative embodiment of a cutter having hardfacing.

FIG. 5 is a forward looking view of an alternative embodiment of a cutter 102 having hardfacing 54 applied thereon. In this embodiment the cutter comprises a nose row 104 of nose row teeth 106 illustrated circumscribing the cutter center 105. Also included is a middle (or inner) row 108 having middle row guide teeth disposed along the row 108. Middle row hardfacing 124 is shown applied on the row 108 forming a hardfacing web spanning between oppositely facing flanks 111 of adjacent middle row teeth 110. In this embodiment, the middle row hardfacing 124 projects upward from the upper surface of the middle row 108. The middle row hardfacing 124 of this embodiment also extends outward past the middle row 108 outer radius. As seen in FIG. 6, the middle row hardfacing 124 also projects up from the lower surface of the middle row 108. Thus, the hardfacing 124 forms a protruding ridge 125 of hardfacing material having an upper portion 126 (see FIG. 5) and a lower portion 127 that run respectively along the middle row 108 upper and lower surfaces. The portions 126, 127 are joined by a mid-section 129 that sits on the row 108 outer diameter that is generally transverse to the row 108 circumference. In the embodiment shown, the upper and lower portions 126, 127 are generally oriented along a line (not shown) directed to the cutter center 105.

Referring back to FIG. 5, the cutter 102 embodiment further includes a heel row 112 of heel row guide 114 teeth. Heel row hardfacing 128 is shown applied between oppositely facing flanks 113 of adjacently located heel row guide teeth. The heel row hardfacing 128 also includes a ridge 132 (FIG. 6) having upper and lower portions 135, 136 respectively protruding from the row 112 upper and lower surfaces. The portions 135, 136 are connected by a mid-section 137 on the row 112 outer diameter. The mid-section 137 is shown generally transverse to the row 112 circumference and the upper and lower portions 135, 136 are both are generally aligned with a line directed to the cutter center 105.

The heel row hardfacing 128 includes a web 133 that laterally extends from the ridge 132 along the row 112 outer diameter. Referring now to FIG. 6, the heel row hardfacing also includes a body 130 formed around the gage surface of the heel row 112. Once applied, the hardfacing defines an integral connected body. Optional apertures 134 are shown formed through the body 130 that provide an opening to the heel row 112 gage surface. Also, slots 138 may be optionally included on the body outer circumferential edge 131, exposing sections of the crest 115 of the heel row guide teeth.

FIG. 7 provides a perspective view of an alternative embodiment of a portion of the cutter 102, before hardfacing is applied to the cutter 102. In this view the heel row 112 gage surface includes an optional curved recess 116 formed on an outer surface of a heel row guide tooth 114. The recess 116 provides added space for an inclusion of hardfacing to thereby increase cutter 102 operational life. Also shown in FIG. 7 are a pocket 118 provided on the heel row 112 outer surface and a space 120 on the row 112 outer diameter; both the pocket 118 and the space 120 are provided between adjacently located heel row teeth 114. Like the recess 116, the added volume of the pocket 118 and the space 120 are for receiving hardfacing therein to better couple the hardfacing to the cutter 102 and add hardfacing structure to longer cutting life. More specifically, the space 120 provides a base on which a cutting element can be secured and the pocket 118 can extend full cutting structure length usable for maintaining hole size.

FIG. 8 is a perspective view of the cutter embodiment of FIG. 7, wherein hardfacing 128 is applied onto the heel row 112 but not shown on the middle row 108. In this view, pockets 109 are illustrated between adjacent middle row teeth 110, where the pockets 109 comprise a generally circular base, which is a shape to provide a maximum volume for receiving hardfacing therein to form the middle row hardfacing. FIG. 8 also depicts the ridges 132 of hardfacing extending along the heel row 112 upper surface and ending adjacent the heel row 112 inner radius 123.

FIG. 9 illustrates a perspective view of an embodiment of a section of heel row hardfacing 128. For clarity, the heel row hardfacing 128 is depicted separate from the cutter 102. In actuality, the hardfacing 128 is typically formed by welding material directly to a cutter, thus heel row hardfacing 128 would not exist apart from a cutter. As shown the heel row hardfacing 128 comprises an annular body 130, that when formed on the cutter 102 may be aligned coaxially along a row surface. While depicted herein as being on the row outer surface, the body 130 can optionally be provided on the inner surface, or both. In the embodiment of FIG. 9, the body 130 is a single uni-body member that circumscribes a cutter. Webs 133 are shown depending from the body 130 at sections along the body 130 outer radius. The ridges 132 are on the webs' 133 outer surface and project outward from both the upper and lower surfaces and also project from the body 130 (and thus a cutter) outer radius. The hardfacing ridges 132 therefore provide a cutting member useful in excavating, such as for forming a subterranean borehole.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

We claim:

1. An earth boring bit comprising:

a body;

a leg depending from the body;

a bearing shaft extending radially inward from the leg;

a cutter mounted on the bearing shaft, the cutter having a row of teeth hardfacing guides, the teeth hardfacing guides having a base and flanks extending from the base and joining to form a crest; and hardfacing spanning between opposing flanks of adjacently disposed teeth hardfacing guides, the hardfacing forming a web between the adjacently disposed teeth hardfacing guides and ridges on the web, the ridges projecting laterally past the web and extending along the web, inner and outer surfaces, the ridges formed to be primary cutting elements.

2. The earth boring bit of claim 1, wherein the row of teeth hardfacing guides comprise a heel row disposed on the cutter outer periphery.

3. The earth boring bit of claim 1, wherein the row of teeth hardfacing guides comprises an inner row disposed on the cutter.

4. The earth boring bit of claim 1, wherein the ridges are substantially aligned with a line extending from the cutter center.

5. The earth boring bit of claim 1, wherein the hardfacing comprises a uni-body construction circumscribing the row of hardfacing guide teeth.

6. The earth boring bit of claim 5, wherein the hardfacing comprises a ring like body coupled to the row outer side, wherein the webs project from the body outer circumference, and the ridges are formed on the webs.

7. The earth boring bit of claim 1, further comprising a curved recess formed on an outer side of a hardfacing guide tooth having hardfacing extending therein.

8. The earth boring bit of claim 1, further comprising a pocket provided on the lower side of the row and between adjacent hardfacing guide teeth, the pocket having hardfacing extending therein.

9. The earth boring bit of claim 1, further comprising a space formed between adjacent crests on hardfacing guide teeth, the space having hardfacing inside.

10. The earth boring bit of claim 1, wherein the hardfacing comprises an earth boring cutting surface on its upper periphery.

11. An earth boring bit comprising:

a body;

a cutter rotatably mounted on the body;

a heel row of teeth hardfacing guides around the cutter integrally formed with the cutter;

an inner row of teeth hardfacing guides concentrically disposed within the row of teeth hardfacing guides on the heel portion;

web members spanning between adjacently disposed guide teeth, the web members depending from the body: and a space formed between adjacent crests on hardfacing guide teeth, the space having hardfacing inside.

12. The earth boring bit of claim 11, wherein ridges are formed on the web members.

13. The earth boring bit of claim 12, wherein the ridges are elongate members having an inner and outer portion respectively extending on the inner and outer opposite surface of the row of teeth, the inner and outer portions oriented along a line directed to the cutter center, the inner and outer portions connected by a middle portion, the middle portion positioned proximate the body outer periphery and oriented transverse to the body outer circumference.

14. An earth boring bit comprising:

an inner row of hardfacing guides;

a heel row of hardfacing guides;

a continuous layer of hardfacing extending circumferentially around on the inner and outer surfaces of the inner row and outer row, including webs of hardfacing between each of the hardfacing guides on each row, the webs having crests defining an outer diameter; and protrusions projecting from the inner sides and outer sides of each row and the crests to serve as teeth.

* * * * *